United States Patent [19]

Gartung

[11] 4,176,889

[45] Dec. 4, 1979

[54] MODULAR STORAGE UNIT ASSEMBLY

[75] Inventor: Clifford W. Gartung, Newport Beach, Calif.

[73] Assignee: Pleion Corporation, Santa Ana, Calif.

[21] Appl. No.: 920,980

[22] Filed: Jun. 30, 1978

[51] Int. Cl.[2] ..... A47B 47/00; A47B 3/06

[52] U.S. Cl. ..... 312/195; 108/26; 312/108

[58] Field of Search ..... 312/194, 195, 257 R, 312/257 SK, 257 SM, 108, 111, 107; 108/26

[56] References Cited

U.S. PATENT DOCUMENTS

| | | | |
|---|---|---|---|
| 1,788,328 | 1/1931 | Roberts | 312/194 |
| 2,987,362 | 6/1961 | Bernath | 312/257 R |
| 4,101,183 | 7/1978 | McManus | 312/195 |

FOREIGN PATENT DOCUMENTS

| | | | |
|---|---|---|---|
| 679312 | 9/1952 | United Kingdom | 312/108 |

*Primary Examiner*—Mervin Stein
*Assistant Examiner*—Alexander Grosz
*Attorney, Agent, or Firm*—Jackson, Jones & Price

[57] ABSTRACT

A versatile modular storage unit assembly adapted for mounting to office furniture is provided wherein the number and position of the individual storage units may be subjectively determined. A plurality of support channels are mounted to a lower periphery of a work surface. A plurality of individual storage units which include a frame, are provided on a top surface thereof with a plurality of mounting rails. The mounting rails are complementary to the support channels and are designed to be slideably engageable by the support channels. A plurality of mounting channels are attached to a lower surface of the frame of each individual storage unit. The mounting channels are similar in construction to the support channels and are capable of slideably engaging and holding the mounting rails which are attached to the storage units. A plurality of bolts engaging the mounting rails and respectively the support channels or mounting channels prevent accidental dislocation of the storage units.

20 Claims, 6 Drawing Figures

MODULAR STORAGE UNIT ASSEMBLY

BACKGROUND OF THE INVENTION

1. Field of the Invention

The present invention relates to a modular storage unit assembly and more particularly to a modular storage unit assembly wherein the number of storage units may be subjectively selected and the storage units may be subjectively positioned.

2. Description of the Prior Art

The prior art is well aware of modular storage units. The prior art is also well aware of file cabinets and office desks having such storage units built thereinto as drawers. However, there is still a demand in the prior art for a simple, versatile and relatively economical modular storage unit assembly which can be utilized in conjunction with office furniture such as shelves, cabinets and desks and which allows subjecting positioning of the individual storage units according to the particular needs of a user of the office furniture.

SUMMARY OF THE IVENTION

It is an object of the present invention to provide a modular storage unit assembly which is of simple and rugged construction and economical to manufacture.

It is another object of the present invention to provide a modular storage unit assembly which permits the subjective selection of the required number of storage units.

It is still another object of the present invention to provide a modular storage unit assembly which is mountable to standard office furniture such as a desk and which permits the subjective positioning of the required number of storage units relative to a basic support frame of the office furniture.

It is yet another object of the present invention to provide a modular storage unit assembly wherein the indivdual units may be such varied objects as drawers, typewriter cases, index card holders etc..

These and other objects and advantages are attained by a modular storage unit assembly having a housing structure such as a desk, including a planar work surface, a plurality of modular storage units and a support channel mounted substantially horizontally below the work surface of the housing structure. The support channel is an open faced channel member having a substantially U shaped cross section which comprises a base plate and two side plates. The side plates are provided at predetermined locations with flanges, which are substantially parallelly disposed to the base plate. The individual storage units which may comprise frames having a drawer mounted thereinto, have at least one mounting rail attached to a top surface of the frame. The mounting rails are slidingly fitted and held within the flanges provided in the support channels. Each individual storage unit also incorporates at least one mounting channel similar in construction to the support channels. The mounting channels are fixedly attached to a lower surface of the individual storage unit. The mounting rails on the top surfaces of the storage units are also capable of slideably engaging the mounting channels provided on the lower surface of another storage unit. A plurality of threaded members such as bolts secure the mounting rails in the support channels or in the mounting channels to prevent their accidental sliding motion and disengagement.

The objects and features of the present invention are set forth with particularly in the appended claims. The present invention may be best understood by reference to the following description taken in connection with the accompanying drawings wherein like parts are designated by like numerals.

DESCRIPTION OF THE PREFERRED EMBODIMENTS

The following specification taken in conjunction with the drawings sets forth the preferred embodiment of the present invention in such a manner that any person skilled in the office furniture manufacturing arts can use the invention. The embodiment of the invention disclosed herein is the best mode contemplated by the inventor for carrying out his invention in a commercial environment although it should be understood that various modifications can be accomplished within the parameters of the present invention.

Figure 1:
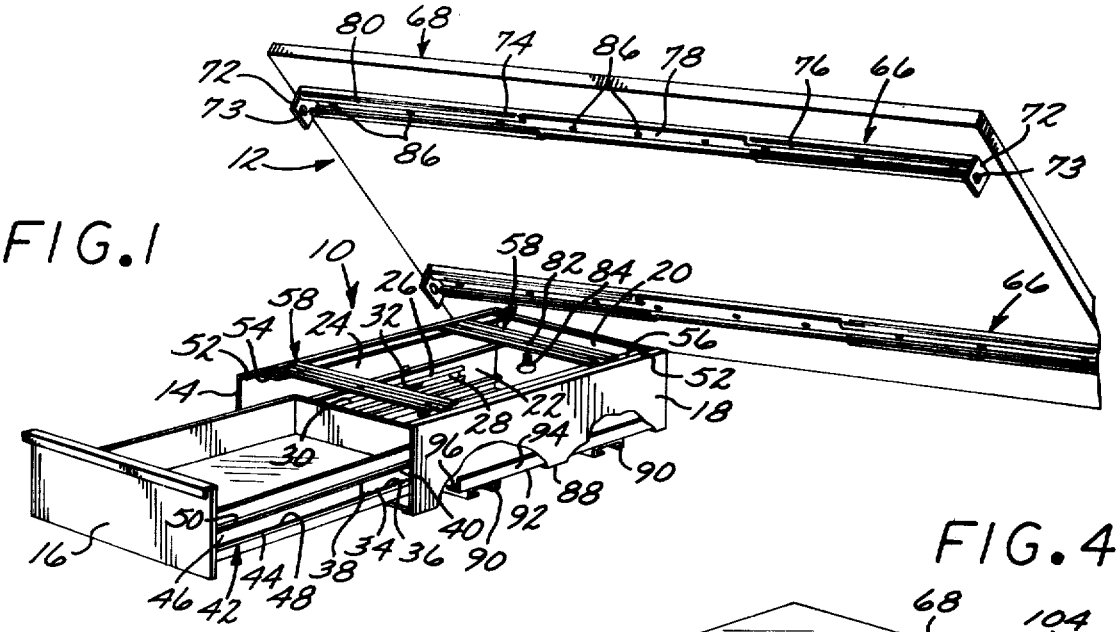
FIG. 1 is a perspective exploded view of a storage unit of the present invention mounted to a desk-top with parts of a frame of the storage unit broken away.

Referring specifically to the exploded perspective view of FIG. 1, a preferred embodiment of the modular storage unit 10 of the present invention and a work surface 12 to which it is attached, is disclosed. The modular storage unit 10 of this preferred embodiment comprises a frame 14 into which a drawer 16 is slideably mounted. The frame 14 comprises two side panels 18 and a back panel 20. The side panels 18 and the back panel 20 are permanently joined together by a method well established in the art, such as for example spot welding. The frame 14 of this preferred embodiment is adapted for slideable mounting of the drawer 16.

Even though the mounting of the drawer 16 within the frame 14 may be accomplished according to accepted practices in the art for the sake of completeness, the method of mounting the drawers of the present invention is briefly described here. An open faced channel member 22 having a substantially U shaped cross section is permanently attached to an inside surface 24 of each side panel 18. Each channel member 22 is disposed within the frame 14 with its longitudinal axis being substantially parallel to the longitudinal axis of the side panels 18. Within each channel member 22 is mounted a second smaller open faced channel member 26 also having a substantially U shaped cross section. Each second channel member 26 comprises a base plate 28 and two side flanges 30, the side flanges 30 being diposed substantially perpendicularly to the base plate 28. Each side flange 30 is provided with an indentation or groove 32 substantially along its entire length. The indentation or groove 32 serves the purpose of receiving and guiding a plurality of ball bearings 34.

The ball bearings 34 are positioned within perforations 36 provided in side flanges 38 of a third open faced channel member 40. The latter is dimensioned to slide over the side flanges 30 of the second channel member 26 so that the ball bearings 34 are disposed for rolling motion in the grooves 32. A fourth open faced channel member 42 also having a substantially U shaped cross section, two side flanges 44 and a base plate 46 is dimensioned to slide over the third channel member 40 and the ball bearings 34. The side flanges 44 of the fourth channel member 42 are also provided along substantially their entire length with an indentation or groove 48 so that the ball bearings 34 held within the perforations 36 are capable of a rolling motion guided between the groove 32 provided on the second channel member 26 and the groove 48 provided on the fourth channel member 42. The top side flange (not shown) of each of the fourth channel members 42 is capable of supporting a mounting ledge 50 fixedly attached to the drawer 16.

As a result of the above described structure, the drawer 16 is simple mounted within the frame 14 in the following manner: the mounting ledges 50 provided on both sides of the drawer 16 are simply placed upon the top side flanges 44 of the fourth channel member 42. A slit or hole (not shown) provided in each side flange 44 engages a protruding member (not shown) on the bottom side of each mounting ledge 50 thereby preventing a sliding motion of the mounting ledge 50 relative to the fourth channel member. The drawer 16 together with the fourth channel member 42 is capable of in-and-out sliding motion relative to the frame 14 while the third channel members 40 incorporating the ball bearings 34 move relative to both the second 26 and fourth channel member 42.

Figure 3:
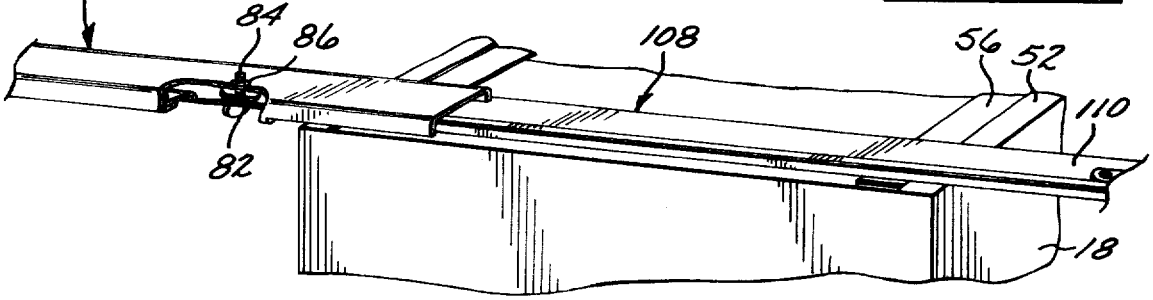
FIG. 3 is a partial perspective view of a storage unit of the present invention having a second embodiment of the mounting rail, with parts of a support channel broken away.

Returning now to the description of the frame 14 and specifically referring to FIGS. 1 and 3, each side panel 18 is provided on a top portion thereof with a side rail or ear 52 which extends along the entire length of the side panel 18 perpendicularly to a plane generally defined by the side panel 18. A support member 54 having an L shaped cross section is fixedly attached by conventional methods such as for example spot welding to each side panel 18 and to its ear portion 52 in such a manner that a top plate 56 of the support member 54 is disposed horizontally. Thus the top plate 56 lies parallel with the ear 52. One purpose of providing the ears 52 and the support members 54 is to provide additional strength to the frame 14. This is especially desirable in view of the fact that the entire modular storage unit 10 is suspended from the work surface 12 by two mounting rails 58 which are permanently attached to the top plates 56 of the support members 54.

Figure 2:
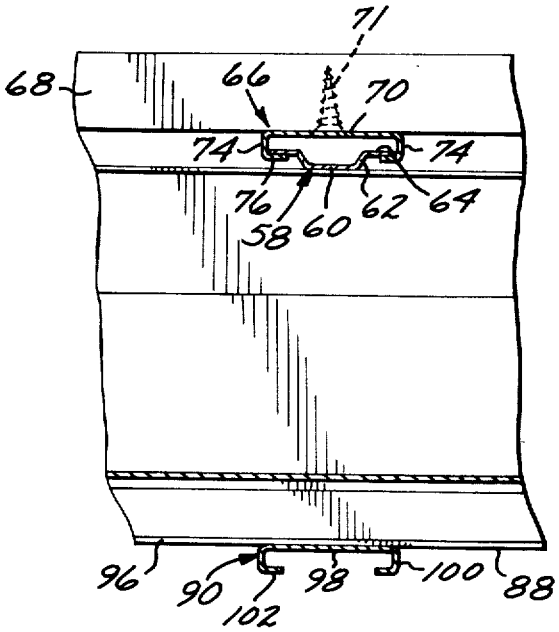
FIG. 2 is a partial cross sectional view of a mounted storage unit of the present invention.

Referring to FIGS. 1 and 2 and especially to the cross sectional view of FIG. 2, the structure of the mounting rails 58 is disclosed. Each mounting rail 58 which may be conveniently manufactured, e.g. from rolled steel, comprises a base plate 60 and two side plates 62. A flange 64 extends sideways from each side plate 62 in a plane substantially parallel with the plane of the base plate 60. As this is clearly shown in FIG. 1, the mounting rails 58 are located on the top portion of the frame 14 and are disposed substantially perpendicularly to the plane generally defined by the side panels 18.

The perspective view of FIG. 1 also discloses the lower periphery of the work surface 12 of a housing structure which supports the entire modular storage unit assembly. While the housing structure may comprise the frame of a shelving assembly or the like, in this preferred embodiment the housing structure is a desk, and the work surface is a desk top.

Two parallely positioned support channels 66 are fixedly attached to the lower surface of the desk top 68. For the purposes of the present invention the desk top may comprise metal, wood, suitable plastic material or particle board. Each support channel 66 includes a base plate 70 which is positioned parallel to the lower surface of the desk top 68 being permanently attached thereto by some suitable fastener such as screws 71 (shown on FIG. 2).

The base plate 70 of each support channel 66 is provided at each end thereof with an ear portion 72. The ear portions 72 are disposed substantially perpendicularly to the base plate 70 and have an aperture or hole 73 therein. Suitable fasteners such as nails or screws (not shown) can be applied through the holes 73 thereby further attaching the support channels 66 to a plurality of legs (not shown) of the desk assembly. Each support channel 66 which comprises an open face channel member having a substantially U shaped cross section, also has two side plates 74. Each side plate 74 is disposed substantially perpendicularly to the base plate 70 of the support channel 66.

A pair of flanges 76 extend from the side plates 74 at predetermined locations in such a manner that the flanges 76 are disposed substantially parallel to the base plate 70 of the support channel 66. Since the flanges 76 point toward each other they define a partially enclosed space within the flanges 76, side plates 74 and the base plate 70. FIG. 1 discloses an intermediary portion 78 of the support channel 66 wherein the side plates 74 are not provided with flanges 76. The length of this intermediate portion 78 is at least equal to the overall length of the mounting rails 58.

Since the support channels 66 having the flanges 76 are dimensioned to be complementary to the mounting rails 58, the modular storage unit 10 is readily mounted to the desk top 68 by simply positioning the storage unit 10 in such a manner that the mounting rails 58 on the top thereof are located in the intermediary portion 78 of the support channels 66. Thereafter the storage unit 10 is conveniently attached to either flanged portion 80 of the support channels 66 at the subjective selection of a user of the desk assembly by merely inserting the mounting rails 58 within either flanged portion 80 of the support channels 66.

In order to fixedly but removably position the modular storage unit 10 within the support channels 66 a plurality of threaded apertures 82 are provided within the mounting rails 58. The threaded apertures 82 are capable of receiving complementarily threaded winged bolts 84 which when assembled within the threaded apertures 82 may engage round holes 86 incorporated in the base plate 70 of the support channels 66. Thus as the modular storage unit 10 is assembled via the mounting rails 58 within the flanged portions 80 of the support channel 66, the modular storage unit 10 may be removably secured therein by the winged bolts 84.

Figure 4:
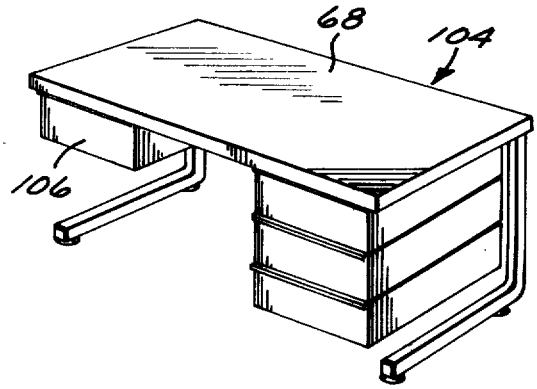
FIG. 4 is a schematic perspective view of an office desk in accordance with the present invention having a plurality of storage units subjectively positioned thereto.

Referring now specifically to FIGS. 2 and 4 the mounting of additional storage units to a first storage unit 10 is disclosed.

Each storage unit 10 of the preferred embodiment of the present invention is provided on a bottom portion 88 thereof with two mounting channels 90. The mounting channels 90 are attached by some suitable method such as spot welding to lower support members 92. The shape and construction of each lower support member 92 is similar to the shape and construction of the support members 54 described above. Thus each lower support member comprises a plate member having an L shaped cross section. Each lower support member 92 is fixedly attached by spot welding or by some other suitable method to a side panel 18 in such a manner that one plate 94 is disposed parallel with and is attached to the side panel 18 while the other plate 96, shown in the cross sectional view of FIG. 2, is disposed horizontally. The two mounting channels 90 are disposed substantially in alignment with the mounting rails 58 provided on the top portion of the frame 14 and are fixedly attached to the respective horizontal plates 96 of the lower support members 92.

The construction of each mounting channel 90 is very similar to the construction of the support channels 66. Thus each mounting channel comprises a base plate 98, two side plates 100 and flanges 102. The side plates 100 are disposed substantially perpendicularly to the base plate 98 and each flange 102 which extends from each side plate 100, is substantially parallel to the base plate 98. Since the flanges 102 extend towards each other a partially enclosed space is formed within the base plate 98, side plates 100 and flanges 102. Each mounting channel 90 is dimensioned to be complementary to the mounting rails 58. Therefore additional storage units can be suspended from the mounting channels 90 by simply inserting the complementary mounting rails 58 of the additional storage unit into the mounting channels 90 located on the bottom portion 88 of an already assembled storage unit.

The additional storage unit may be temporarily secured in a manner very similar to the securing of the storage unit 10 to the support channels 66. Thus the winged bolts 84 engaging the threaded apertures 82 which are provided within the mounting rails 58 can also engage holes (not shown) provided at appropriate locations on the base plate 98 of the mounting channels 90. Thereby the accidential dislocation of the storage unit 10 from the bottom of the other storage unit is prevented.

As it should be readily apparent from the above description, the features of the present invention provide the following advantages. The support channels 66 may be attached to a variety of suitable structures such as for example a shelving structure or a desk top. For this reason the modular storage unit assembly of the present invention may be utilized in conjunction with already existing office furniture. Even though in the preferred embodiment of the invention described above, the frames of the individual storage units incorporate drawers, the individual storage units need not be drawers. As an example, the requisite mounting rails may be attached to the supporting frame of a typewriter case. Alternatively a combination of drawers and other units may be used.

Figure 5:
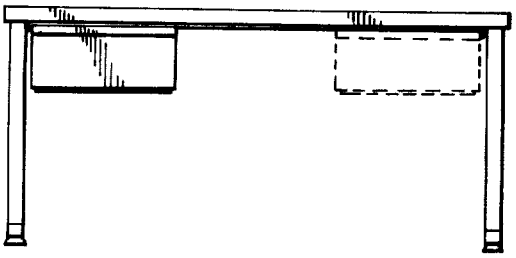
FIG. 5 is a schematic front view of a desk in accordance with the present invention having one modular storage unit assembled thereto, the phantom lines indicating the repositioning of the modular storage unit according to the subjective desire of a user of the desk.

The assembly of the individual units 10 to the support channels 66 and to each other is simple and requires no tools or mechanical skills. Therefore the individual user of the office furniture incorporating the present invention may subjectively select according to his particular needs the number of storage units to be used. He may also subjectively select their positioning relative to the housing structure which is typically a desk. As an example, the schematic view of FIG. 4 shows an office desk incorporating the present invention wherein the individual user has suspended one storage unit on the left side thereof and three storage units on the right side. It is readily apparent from the above description that addition of further storage units to the left side of the desk on FIG. 4 or removal of some or all of the storage units on the right side thereof is a simple matter which can be readily accomplished by a secretary. Furthermore, the storage unit 106 schematically shown on the left side of the desk of FIG. 4 may comprise a typewriter case containing a slideably mounted typewriter according to established practice of the art. In the event the user of the desk, for subjective reasons, wishes to transfer the typewriter cases to the right side of the desk, he may readily do so as it is schematically shown on FIG. 5.

Figure 6:
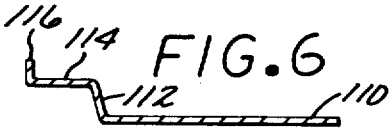
FIG. 6 is a cross sectional view of the second embodiment of the mounting rail of the present invention.

In order to provide the present invention with still further versatility and to enable a user of the invention to mount a storage unit or a plurality of storage units in the intermediate portion 78 of the support channels 66 an alternative embodiment of the mounting rails 108 is provided. The alternative second embodiment of the mounting rail 108 shown on FIG. 3 and in the cross sectional view of FIG. 6, comprises a substantially flat base plate 110, a shorter side plate 112 extending at an obtuse angle from the base plate 110, and a horizontal side plate 114. The horizontal side plate 114 extends from the shorter side plate 112 and is disposed substantially parallel to the plate 110. Finally a rail or ear 116 which is disposed perpendicularly to the horizontal side plate 114 extends from the horizontal side plate 114.

The second embodiment of the mounting rails 108 is attached on the top portion of some of the individual storage units 10 in essentially the same location where the first embodiment of the mounting rails 58 are attached. However, unlike the first embodiment of the mounting rails 58, the second embodiment of the mounting rails 108 extends sideways on both sides of the individual storage units 10. As a result the mounting rails 108 may be inserted within the flanged portions 80 of the support channels 66 as the storage unit 10 is positioned below the intermediary portion 78 of the support channels 66.

Each second alternative embodiment of the mounting rails 108 is dimensioned to slideably fit with its portion having the shorter side plate 112, the horizontal side plate 114 and the ear 116 between the base plate 70 and the flange 76 of the support channel 66. After insertion of the mounting rail 108 within the flanged portions 80 of the support channels 66, the flanges 76 of the support channels 78 support the horizontal side plate 114 of the second embodiment of the mounting rail 108. The storage unit is then further secured by inserting a plurality of winged bolts 84 provided in the mounting rails 108 in the holes 86 located at predetermined complementary locations in the support channels 66. As it is readily apparent from the above description, the individual storage units 10 bearing the second alternative embodiment of the mounting rails 108 may be provided on their respective bottom portions 88 with mounting channels 90. Therefore further units 10 can be assembled to the above unit 10 at the option of the user of the present invention.

It is to be noted that in the preferred embodiments two support channels 66 are provided on the lower periphery of the work surface 12 and correspondingly two mounting rails 58 and two mounting channels 90 are provided on each individual storage unit 10. However it will be readily apparent to a person ordinarily skilled in the art that the present invention may be practiced by utilizing a different number of like parts. Accordingly structures embodying a different number of support channels 66, mounting channels 90 and mounting rails 58 are intended to be within the scope of the present invention.

What has been described above is a versatile modular storage unit assembly of relatively inexpensive, simple and rugged construction. The storage unit assembly of the present invention is particularly adapted for use in conjunction with standard office furniture. The individual units may be selectively positioned in relation thereto according to the subjective needs of the user of the office furniture. It will be apparent to those skilled in the art that various modifications of the present invention are possible and accordingly the scope of the present invention should be interpreted solely from the following claims.

What is claimed is:

1. A desk assembly capable of subjective positioning of storage units, comprising:

a plurality of modular storage units;

A desk top providing a working surface;

means for maintaining the desk top in an operative position;

second means for selectively positioning relative to the working surface and suspendedly mounting at least one storage unit to the desk top, the second means including at least one support channel mounted to a lower surface of the desk top, and a plurality of mounting rails at least one mounting rail being mounted to a top surface of each storage unit, and third means for suspendedly mounting a storage unit to a lower surface of another storage unit, the first of such storage units being suspendedly mounted to the desk top by the second means.

2. The invention of claim 1 wherein the support channel has flanged portions, and the mounting rails are dimensioned to be slidingly engaged and held by the flanged portions, whereby an operator can position a mounting rail between the flanged portions of the support channel and slidingly engage the mounting channel in a subjectively selected flanged portion.

3. The invention of claim 2 wherein the support channel comprises an open faced channel member having a substantially U shaped cross section, the channel member includes a base plate and two side plates, and wherein the flanged portions comprise the channel member and two flanges, each flange being attached to a respective side plate.

4. The invention of claim 3 further comprising at least one threaded member, the threaded member capable of engaging the mounting rails and the support channel thereby fixedly but removably positioning the storage unit relative to the work surface.

5. The invention of claim 4 wherein the third means comprise a plurality of mounting channels and the plurality mounting rails, at least one mounting channel being attached to a bottom surface of each storage unit, the mounting rails capable of being slideably engaged and held by the mounting channels.

6. The invention of claim 1 wherein the third means comprise a plurality of mounting channels and the plurality of mounting rails, at least one mounting channel being attached to a bottom surface of each storage unit.

7. The invention of claim 6 wherein the mounting channels comprise an open faced channel member having a substantially U shaped cross section, the channel member including a base plate and two side plates, and wherein one flange is attached to each side plate whereby the mounting rails can be slideably engaged and held by the flanges.

8. The invention of claim 7 further comprising a plurality of threaded members, at least one threaded member capable of engaging each mounting rail and each mounting channel whereby the storage unit can be fixedly but removably suspended from the mounting channel provided on the bottom surface of another storage unit.

9. A modular storage unit assembly including a support structure, comprising:

at least one storage unit;

at least one support channel, the support channel being mounted to a lower surface of the support structure, at least one mounting rail attached to a top surface of the storage unit, the mounting rail capable of being removably engaged and held by the support channel;

at least one mounting channel attached to the bottom surface of the storage unit, the mounting channel being configured to provide a capability for engaging the mounting rail whereby at least one additional storage unit also having the mounting rail may be optionally mounted to the bottom surface of the storage unit.

10. The invention of claim 9 wherein the support channel has at least two flanged portions, the two flanged portions being separated from one another, the mounting rail capable of being engaged and held by either one of the flanged portions whereby an operator can subjectively position the storage unit relative to the support structure.

11. The invention of claim 10 wherein at least two parallelly disposed support channels are mounted to the lower surface of the support structure; at least two parallelly disposed mounting rails are mounted to the top surface of the storage unit and at least two parallelly disposed mounting channels are mounted to the bottom surface of the storage unit.

12. A modular storage unit assembly capable of being combined with a support structure comprising:

a plurality of storage units;

at least one support channel, the support channel capable of being mounted to a lower surface of a support structure;

a plurality of mounting channels, at least one mounting channel being attached to a bottom surface of each storage unit;

a plurality of mounting rails, at least one mounting rail being attached to a top surface of each storage unit, each mounting rail capable of being removably engaged and held by one of the support channels and a mounting channel whereby a plurality of storage units can be mounted to the support structure by suspending at least one storage unit in the support channel and suspending at least one additional storage unit from the mounting channel provided on the lower surface of the storage unit which is suspended in the mounting channel.

13. The invention of claim 12 wherein the support channel has at least one portion having flanges, and each mounting rail is dimensioned to slidingly engage the portion having flanges.

14. The invention of claim 13 wherein each mounting channel has at least one portion having flanges and each mounting rail is dimensioned to slidingly engage the portion having flanges.

15. The invention of claim 12 wherein the support channel as well as the mounting channels each have at least one portion having flanges and each mounting rail is dimensioned to slidingly engage the flanged portions of both the support channel and the mounting channels.

16. The invention of claim 12 wherein the support channel has at least two portions having flanges and a distance between the two portions having flanges is sufficient to allow positioning a mounting rail between the portions having flanges whereby the mounting rail can be inserted between the portions having flanges and subsequently slidingly engaged in one of the two portions having flanges at the option of a user of the invention.

17. The invention of claim 16 wherein the number of support channels is at least two, the number of mounting rails attached to the top surface of each storage unit is at least two, and wherein the support channels are mounted parallel to each other and the mounting rails are mounted parallel to each other.

18. The invention of claim 16 wherein the support structure is a desk having a general longitudinal axis, and wherein the support channel is mounted parallel with the general, longitudinal axis of the desk, whereby a user of the invention has an option of suspending at least one storage unit in one of the two portions of the support channel having flanges and another option of suspending at least one storage unit from each portion of the support channel having flanges.

19. The invention of claim 18 wherein each storage unit comprises a drawer.

20. The invention of claim 19 wherein each storage unit comprises a drawer and a frame assembly, the drawer being slidingly mounted in the frame assembly and the mounting channels and mounting rails are attached to the frame assembly.

* * * * *